US006619505B1

(12) United States Patent
Decottignies et al.

(10) Patent No.: US 6,619,505 B1
(45) Date of Patent: Sep. 16, 2003

(54) DISPENSER WITH A VISIBLE FLEXIBLE POUCH

(75) Inventors: Laurent Decottignies, Cergy (FR); Firmin Garcia, Evreux (FR)

(73) Assignee: Airlessystems, Charleval (FR)

( * ) Notice: Subject to any disclaimer, the term of this patent is extended or adjusted under 35 U.S.C. 154(b) by 0 days.

(21) Appl. No.: 09/959,152

(22) PCT Filed: Apr. 19, 2000

(86) PCT No.: PCT/FR00/01020

§ 371 (c)(1),
(2), (4) Date: Jan. 11, 2002

(87) PCT Pub. No.: WO00/64595

PCT Pub. Date: Nov. 2, 2000

(30) Foreign Application Priority Data

Apr. 23, 1999 (FR) ..... 99 05888

(51) Int. Cl.[7] ..... B65D 35/28
(52) U.S. Cl. ..... 222/95; 222/105
(58) Field of Search ..... 222/105, 321.7, 222/321.9, 95, 154

(56) References Cited

U.S. PATENT DOCUMENTS 5,263,611 A * 11/1993 Trippen ..... 222/105
5,421,485 A * 6/1995 Furuta et al. ..... 222/105
5,474,212 A * 12/1995 Ichikawa et al. ..... 222/105
5,638,989 A * 6/1997 Ophardt et al. ..... 222/105
6,142,344 A * 11/2000 Kai ..... 222/105

* cited by examiner

*Primary Examiner*—Philippe Derakshani
(74) *Attorney, Agent, or Firm*—Sughrue Mion, PLLC

(57) ABSTRACT

A fluid dispenser comprising: a flexible pouch (3) containing said fluid and provided with an opening (31); a dispensing member (5) such as a pump for drawing off fluid contained in the flexible pouch through said opening (31); and a shell (11, 12) surrounding said pouch (3) and provided with an opening (13) that coincides with the opening (31) of the flexible pouch; the shell being made in two portions (11, 12) assembled together along a connection line (14) passing through the opening (13) in the shell so that each shell portion forms a portion of the opening in the shell; said dispenser being characterized in that at least one shell portion (11, 12) is provided with a window (115, 125), through which the flexible pouch is visible.

8 Claims, 1 Drawing Sheet

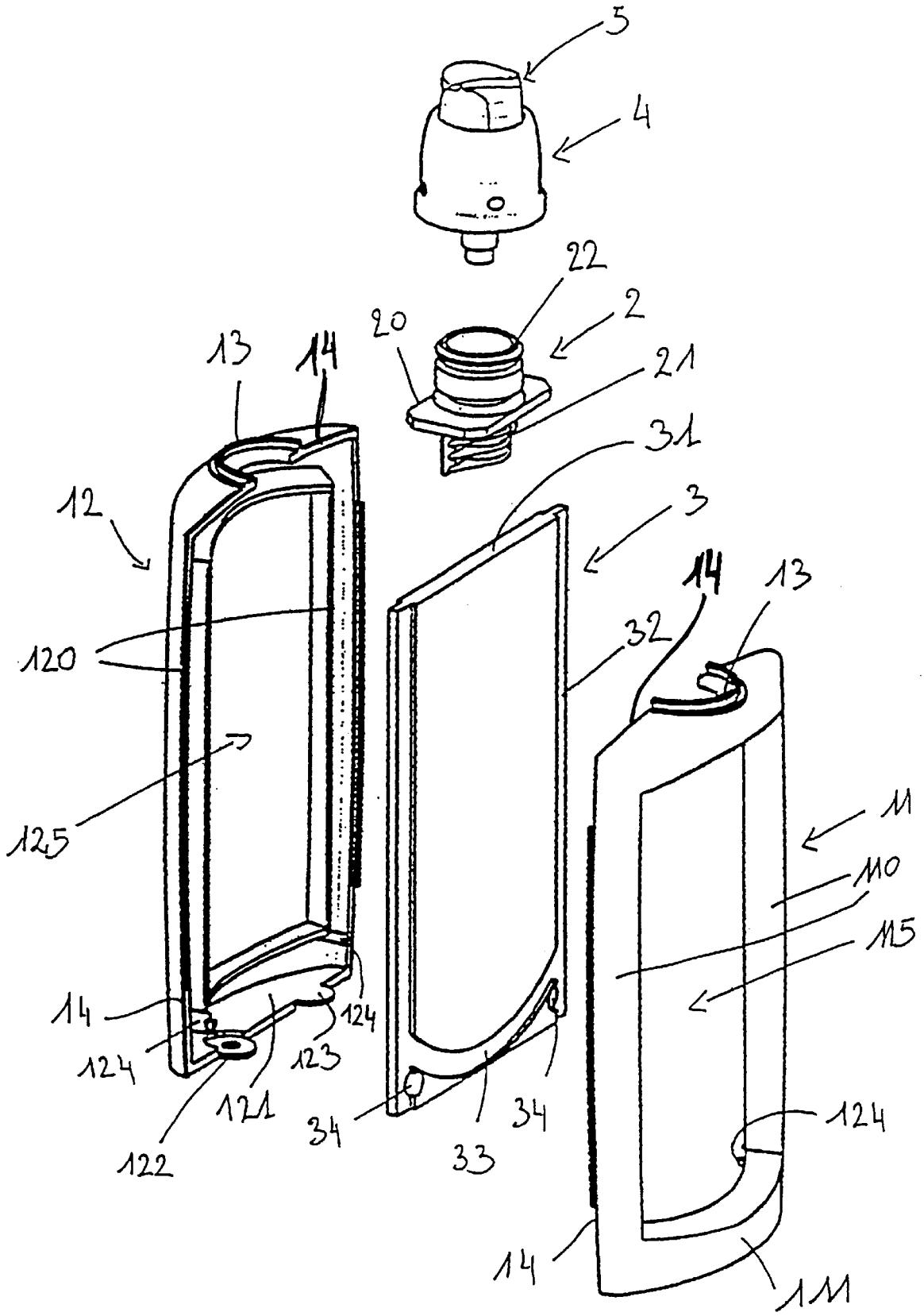
5
4
22
2
20
21
13
14
31
12
3
14
13
120
32
125
11
110
115
14
124
124
123
121
122
34
33
34
124
14
111

DISPENSER WITH A VISIBLE FLEXIBLE POUCH

The present invention relates to a fluid dispenser for dispensing a fluid, said dispenser comprising with a flexible pouch containing said fluid, a dispensing member such as pump for drawing off fluid from the flexible pouch, and an advantageously rigid shell in which the flexible pouch is installed. That type of dispenser is particularly applicable to the field of cosmetics, in particular for dispensing creams that are sensitive to exposure to the atmosphere. The use of a flexible pouch associated with an airless pump makes it possible to keep the fluid out of contact from the ambient air, thereby avoiding any oxidation or deterioration.

In the field of household cleaning materials, it is known that such flexible pouches can be used as disposed in a shell defining two shell portions that are hinged together. For example, mention may be made of Document EP-0 447 687, in which a fluid refill in the form of a flexible pouch mounted on a pouch support is held via the pouch support between two shell portions which, once assembled together, form a rigid shell. To hold the shell portions together, a fixing ring is provided that enables a pump to be mounted on the shell and on the flexible pouch. Document U.S. Pat. No. 5,474, 212 gives another example of a refillable dispenser for household cleaning materials. In such refillable dispensers, the aim is to make it easy for one flexible pouch to be replaced with another flexible pouch. The appearance of such dispensers if of secondary importance since that type of material is sold at low prices.

In the field of cosmetics or perfumes, appearance is of major importance for the product. In addition, dispensers for such a use are not refillable, but rather they are to be discarded once empty. It is therefore not necessary to make it possible for the flexible pouch to be extracted from the rigid shell.

An object of the present invention is to define a fluid dispenser in the field of cosmetics or of perfumes, in which the flexible pouch is advantageously used to impart a pleasing appearance to the dispenser.

To this end, the present invention provides a fluid dispenser as defined in claim 1.

Advantageously, both of the shell portions are provided with windows so that the shell is in the form of a frame or yoke in which the pouch is held.

Preferably, the flexible pouch defines an end wall held between the two shell portions.

The shell, with its two frame portions, is thus used to hold the flexible pouch both at its top end that defines the opening 31 which is fixed to the pouch support 2, and also at its bottom end or end wall 33. In one embodiment, the shell portions form retaining means that co-operate with fixing holes provided in the end wall of the pouch. The end wall of the pouch is thus held in substantially fixed manner between the shell portions as soon as they are assembled together. According to another characteristic of the invention, the pouch defines two side edges disposed without being fixed or held between the two shell portions, so that the side edges can penetrate to varying depths between the side uprights of the shell portions. The width of the flexible pouch varies as a function of its filling state: it is thus easy to understand that the side edges of the pouch move apart as the pouch is being emptied and is thus becoming flattened. In contrast, its height dimension, i.e. the distance between its opening and its end wall substantially does not vary, and it is thus possible to hold it between its two ends inside the shell portions.

In order to assemble the two shell portions together, assembly means are advantageously provided, in the form of male-female connections.

In a practical embodiment, the opening in the pouch is fixed to a pouch support held between the two shell portions. The flexible pouch is thus held at its opening by the pouch support wedged between the two shell portions. Said pouch is also held at its other end, defining the end wall of the pouch.

In another practical embodiment, the dispensing member is fixed to the pouch support by means of a ring snap-fastened to the pouch support and locking the two shell portions together at the opening.

The present invention is described more fully below with reference to the sole FIGURE giving an embodiment of the present invention by way of non-limiting example.

The sole FIGURE is an exploded perspective view of a fluid dispenser of the invention.

The dispenser comprises a flexible pouch 3 defining an opening 31, side edges 32, and an end wall 33. The pouch may be made from a composite film sealed together along the edges 32 and along the end wall 33, the opening 31 giving access to the inside of the pouch. In this embodiment, the opening 31 in the pouch 3 is sealed to a pouch support 2 that defines a sealing appendage 21 and a fixing sleeve 22 for fixing by snap-fastening. A dispensing member 5, which may be a pump, is fixed to the sleeve 22 using a ring 4 defining a snap-fastening band serving to be mounted on the sleeve 22. The support 2 further defines a plate 20 that serves for fixing in the shell.

In the invention, the pouch 3 is disposed inside a substantially-rigid shell that is formed by two shell portions 11 and 12 serving to be assembled together along a connection line 14 that passes through an opening 13 defined by the shell. To hold the pouch 3 inside the two shell portions 11 and 12, the plate 20 defined by the pouch support is wedged between the two shell portions 11 and 12. Once assembled, the snap-fastening sleeve 22 of the pouch support 2 projects through the opening and it is therefore possible to snap-fasten the ring 4 to the sleeve 22. Advantageously, the fixing ring 4 further defines a holding band which co-operates with the edge of the opening 13 so as to lock together the two shell portions 11 and 12 at the opening 13.

The flexible pouch 3 is thus held between the two shell portions 11 and 12 by its pouch support 2 being held between the two shell portions.

In the invention, at least one of the two shell portions 11 and 12 is provided with a window 115, 125 via which the flexible pouch 3 is visible. Such a window may be formed in both of the shell portions 11 and 12, as shown in the sole figure. In which case, the two shell portions together form a frame or a yoke in which the flexible pouch 3 is held. The side edges 32 and the end wall 33 may be disposed between the two frame portions 11 and 12, respectively between the side uprights 110 and 120, and between the end-wall portions 111 and 121. In the invention, the end wall 33 of the flexible pouch 3 is held between the two end wall portions 111 and 121. The two shell portions 11 and 12 therefore serve to hold the end wall 33 of the pouch in addition to serving to hold the plate 20 of the pouch support 2. The flexible pouch is thus held in the shell portions 11 and 12 both at its top end that defines the opening 31, and also at its bottom end that defines the end wall 33. In one embodiment, the end wall 33 of the pouch may be provided with two through holes 34. In addition, at their respective end-walls 111 and 121, the two shell portions 11 and 12 may define retaining means 124, e.g. in the form of lugs co-operating with pegs which pass through the holes 34. Naturally, it is possible to consider using any retaining means for retaining the end wall 33 of the pouch between the end-wall portions 111 and 121 of the shell. The end wall 33 is thus held in substantially fixed manner, while the side edges 32 are merely disposed between the uprights 110 and 120 of the shell portions 11 and 12, without being fixed, and without being retained, i.e. the side edges 32 can penetrate to varying depths between the uprights 110 and 120 as the pouch empties.

To assemble the two shell portions 11 and 12 together at their respective end walls 111 and 121, it is possible to provide assembly means 122, 123, e.g. in the form of a lug 123 co-operating with an eye 122. Each shell portion 11 and 12 may be provided with an eye and a lug serving to co-operate with a lug and an eye formed on the other shell portion. Therefore, the two shell portions 11 and 12 can be exactly identical.

To fix the two shell portions together permanently, it is possible for a heat-sealing operation to be performed along the connection line.

By means of the invention, the flexible pouch 3 is visible through both faces, while also guaranteeing that it is convenient for the dispenser to be held via its shell. The flexible pouch 3 is nevertheless quite firm since it is held via its two ends.

What is claimed is:

1. A fluid dispenser comprising:

a flexible pouch (3) containing said fluid and provided with an opening (31);

a dispensing member (5) such as a pump for drawing off fluid contained in the flexible pouch through said opening (31); and a shell (11, 12) surrounding said pouch (3) and provided with an opening (13) that coincides with the opening (31) of the flexible pouch;

the shell being made in two portions (11, 12) assembled together along a connection line (14) passing through the opening (13) in the shell so that each shell portion forms a portion of the opening in the shell, the connection line defining a contact zone between the two portions, at least one shell portion (11, 12) being provided with a window (115, 125), through which the flexible pouch is visible, said dispenser being characterized in that the pouch defines two side edges (32) and the shell portions each comprise two uprights (110, 12) with each side edge (32) being disposed, without being fixed or held, between the two uprights (110, 120), so that the side edges (32) can penetrate to varying depths between the side uprights (110, 120) of the shell portions (11, 12).

2. A dispenser according to claim 1, in which both of the shell portions (11, 12) are provided with windows (115, 125) so that the shell is in the form of a frame or yoke in which the pouch is held.

3. A dispenser according to claim 1, in which the flexible pouch (3) defines an end wall (33) held between the two shell portions (11, 12).

4. A dispenser according to claim 3, in which the shell portions (11, 12) form retaining means (124) that co-operate with fixing holes (34) provided in the end wall (33) of the pouch.

5. A dispenser according to claim 1, in which each of the shell portions (11, 12) defines an end wall (111, 121) provided with assembly means.

6. A dispenser according to claim 1, in which the opening (31) in the pouch is fixed to a pouch support held between the two shell portions (11, 12).

7. A dispenser according to claim 6, in which the dispensing member (5) is fixed to the pouch support (2) by means of a ring (4) snap-fastened to the pouch support and locking the two shell portions (11, 12) together at the opening (13).

8. A dispenser according to claim 1, wherein the side edges (32) of the pouch are thin and the uprights (110, 120) define slots between them, and wherein the side edges are freely inserted in the slots.

* * * * *